US010713995B2

(12) United States Patent
Tsuchi et al.

(10) Patent No.: US 10,713,995 B2
(45) Date of Patent: Jul. 14, 2020

(54) OUTPUT CIRCUIT, DATA LINE DRIVER, AND DISPLAY DEVICE

(71) Applicant: LAPIS SEMICONDUCTOR CO., LTD., Kanagawa (JP)

(72) Inventors: Hiroshi Tsuchi, Kanagawa (JP); Takeshi Nosaka, Kanagawa (JP); Koji Higuchi, Kanagawa (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 15/953,972

(22) Filed: Apr. 16, 2018

(65) Prior Publication Data

US 2018/0301079 A1 Oct. 18, 2018

(30) Foreign Application Priority Data

Apr. 17, 2017 (JP) ..... 2017-081578

(51) Int. Cl.
*G09G 3/20* (2006.01)
*G09G 3/36* (2006.01)

(52) U.S. Cl.
CPC ..... *G09G 3/2011* (2013.01); *G09G 3/3688* (2013.01); *G09G 3/3696* (2013.01); *G09G 2310/027* (2013.01); *G09G 2310/0291* (2013.01); *G09G 2310/06* (2013.01); *G09G 2320/0276* (2013.01)

(58) Field of Classification Search
CPC combination set(s) only.
See application file for complete search history.

(56) References Cited

U.S. PATENT DOCUMENTS 3,509,279 A * 4/1970 Olson ..... H03K 5/24 200/51 R
5,831,605 A * 11/1998 Yasui ..... G09G 3/3655 345/211
2005/0047526 A1* 3/2005 Watanabe ..... H04L 27/00 375/316
2017/0249894 A1* 8/2017 Tsuchi ..... G09G 3/2092

FOREIGN PATENT DOCUMENTS

JP 2001108966 A 4/2001

* cited by examiner

*Primary Examiner* — Van N Chow
(74) *Attorney, Agent, or Firm* — Volentine, Whitt & Francos, PLLC

(57) ABSTRACT

An output circuit includes a differential amplifier including an inverting input terminal, non-inverting input terminals and an output terminal, and outputs, from the output terminal, a voltage having a level corresponding to a weighted average of respective input voltage levels of the non-inverting input terminals, when the output voltage level is equal to a input voltage level of the inverting input terminal, and outputs a voltage having a level corresponding to a difference between a level corresponding to a weighted average of the respective input voltage levels of the non-inverting input terminals and the input voltage level, when which the output voltage level is different from the input voltage level; and a delay circuit that generates a delay voltage responding with a predetermined time constant with respect to a change in the output voltage level and supplies the delay voltage to the inverting input terminal.

6 Claims, 11 Drawing Sheets

RELATED ART

RELATED ART

RELATED ART

OUTPUT CIRCUIT, DATA LINE DRIVER, AND DISPLAY DEVICE

CROSS-REFERENCE TO RELATED APPLICATION

This application claims priority under 35 USC 119 from Japanese Patent Application No. 2017-081578, filed on Apr. 17, 2017, the disclosure of which is incorporated by reference herein.

BACKGROUND

Technical Field

The present disclosure relates to an output circuit, a data line driver, and a display device.

Related Art

As a technique for driving a display device such as a liquid crystal panel, for example, Japanese Patent Application Laid-Open (JP-A) No. 2001-108966 discloses using, as a signal input to a liquid crystal panel through an operational amplifier, a signal obtained by superimposing a first wave of a rectangular wave that serves as a base of a driving signal, and a second wave in which an amplitude in a rising direction of the first wave and an amplitude in a falling direction of the first wave are increased. By superimposing the second wave on the first wave, an amount of charges supplied to each pixel of the liquid crystal panel at an initial write stage can be increased, as compared with the case in which simply applying the first wave to the liquid crystal panel. Further, in the above technique, even in a case in which the charge supply capability of a reference potential line is insufficient, it is possible to obtain a desired charging amount in each pixel within a desired write time.

Currently, an active matrix type liquid crystal monitor, an organic EL monitor, or the like is mainly used as display devices. Such display devices include a display panel in which display cells connected to plural data lines are arranged in a matrix form, and a data line driver which drives each of plural data lines. Recently, higher image quality is required in mobile devices, televisions, or the like, for high-end applications including thin display devices. Specifically, for multi-color (multi-gradation) of RGB 8-bit video data (about 16.8 million colors) or more and improvement in characteristics of moving pictures, there is also a demand to increase a frame frequency (drive frequency for rewriting one screen) to 120 Hz or more. However, in a case in which the frame frequency becomes N times, one data output period becomes approximately 1/N.

Here, the data line driver outputs an output voltage obtained by amplifying an input signal voltage that correspond to a luminance level indicated by a video signal, and supplies the output voltage to a data line of a display panel so as to charge or discharge the load capacity of the data line. An output circuit of the data line driver is required to have high driving capability so as to charge and discharge the load capacity of the data line at a high speed. In addition, in order to equalize gradation voltage that are to be written to the display element, uniformity in a slew rate (voltage change amount per unit time) at the time of charging and discharging is also required.

FIG. 1 is a circuit block diagram illustrating an example configuration of a data line driver 100A. In FIG. 1, a data line 151 driven by the data line driver 100A is illustrated together with the data line driver 100A. FIG. 1 illustrates a configuration corresponding to one data line 151 only convenience, but generally, plural output circuits corresponding to plural data lines are provided in a display panel such as a liquid crystal panel.

The data line 151 can be represented as a wiring load model in which an L-type load including a resistor $R_L$ and a capacitor $C_L$, is cascade-connected. In FIG. 1, for convenience, the data line 151 is represented by a wiring load model of two-stage cascade connection. A combined resistance value $R_{load}$ of the resistor $R_L$ is a wiring resistance value of one data line, and a combined capacitance value $C_{load}$ of the capacitor $C_L$ is a wiring capacitance value of one data line. In the following, in the data line 151, a node of a connection point with the data line driver 100A will be referred to as a near end node, and a node farthest from the data line driver 100A will be referred to as a far end node $N_L$.

The data line driver 100A includes a resistance-division-type digital-to-analog converter 30A (hereinafter referred to as an R-DAC 30A) and a differential amplifier 10A. Plural gamma power supply voltages $V_{G0}$ to $V_{Gm}$, n-bit video digital signals $D_0$ to $D_{n-1}$, and complementary signals $XD_0$ to $XD_{n-1}$ thereof are input to the R-DAC 30A. The R-DAC 30A outputs a reference voltage $V_i$ which is selected from plural reference voltages generated by resistance division of the gamma power supply voltages $V_{G0}$ to $V_{Gm}$ and corresponding to a gradation level by the video digital signals $D_0$ to $D_{n-1}$ and the complementary signals $XD_0$ to $XD_{n-1}$ thereof.

The reference voltage $V_i$ output from the R-DAC 30A is input to a non-inverting input terminal of the differential amplifier 10A. The differential amplifier 10A outputs, from an output terminal, an output voltage $V_{OUT}$ of a voltage level corresponding to the reference voltage $V_i$. The output terminal of the differential amplifier 10A is connected to the data line 151 through an output pad P.

For example, the R-DAC 30A receives the 8-bit video digital signals $D_0$ to $D_{n-1}$ and the complementary signals $XD_0$ to $XD_{n-1}$ thereof and generates the reference voltage $V_i$ having up to $2^8$ (=256) multi-level voltage levels. The R-DAC 30A generates the reference voltage $V_i$ by a resistance division circuit configured to include plural resistive elements. Therefore, the R-DAC 30A has high output impedance and low current driving capability. The differential amplifier 10A impedance-converts the reference voltage $V_i$ output from the R-DAC 30A, outputs the current-amplified output voltage $V_{OUT}$ (gradation voltage), and supplies the output voltage $V_{OUT}$ to the data line 151. Since the differential amplifier 10A outputs the output voltage $V_{OUT}$ corresponding to the reference voltage $V_i$ with high accuracy, the differential amplifier 10A is generally configured by a voltage follower having an amplification factor of 1.

Recently, along with an increase in the screen size and the resolution of the display device, as the load capacity of the data line increases, a driving period (one data period) during which the data line driver drives the data line tends to be shortened. In a case in which the load capacity of the data line is large and the driving period (one data period) is shortened, a voltage pulse dullness due to the output voltage (gradation voltage) of the data line driver increases from the near end node to the far end node $N_L$ of the data line, and a write rate of a pixel (arrival rate for a target voltage) decreases. Therefore, a luminance difference occurs in plural pixels arranged along the data line, which may result in image quality deterioration.

FIG. 2 is a view illustrating an example of a voltage waveform of each of the data line driver 100A and the data line 151 illustrated in FIG. 1, in a case in which the load capacity of the data line 151 is relatively large and the driving period (one data period) is relatively short. A waveform F1 is a waveform of the reference voltage $V_i$ input to the differential amplifier 10A, and a waveform F2 is a waveform of the output voltage $V_{OUT}$ (gradation voltage) output from the differential amplifier 10A, that is, a voltage waveform at the near end node of the data line 151. A waveform F3 is a voltage waveform of the far end node $N_L$ of the data line 151. The waveform F2 of the output voltage $V_{OUT}$ (the voltage of the near end node of the data line 151) quickly reaches the gradation voltage which is a target voltage at a constant slew rate determined by the circuit configuration of the differential amplifier 10A. The waveform F3 of the far end node $N_L$ of the data line 151 has a delay (waveform dullness) determined by a time constant $\tau_1$ ($=R_{load}\times C_{load}$) of the data line 151. The delay (waveform dullness) occurring in the waveform F3 increases with an increase in the resistance value and the capacitance value of the data line 151. In a case in which the driving period (one data period) is short, the voltage of the far end node $N_L$ of the data line 151 is shifted to a next driving period (period from time t1 to time t2), while the voltage of the far end node $N_L$ of the data line 151 does not reach the gradation voltage which is the target voltage within the driving period (one data period) from time t0 to time t1. Therefore, a difference occurs in a write voltage for a pixel between the near end node and the far end node $N_L$ of the data line 151. This causes a luminance difference between the near end node and the far end node $N_L$ of the data line 151 and the display quality become deteriorated.

In the technique disclosed in JP-A No. 2001-108966, a signal, obtained by superimposing a first wave of a rectangular wave which serves as a base of a driving signal and a second wave in which an amplitude in a rising direction of the first wave and an amplitude in a falling direction of the first wave are increased, is used as a signal input to a liquid crystal panel through an operational amplifier. Accordingly, suppression of voltage difference between the near end node and the far end node of the data line can be expected. However, a driving circuit disclosed in JP-A No. 2001-108966 cannot be configured by a simple output circuit, such as the data line driver 100A illustrated in FIG. 1. FIG. 3 is a circuit block diagram illustrating a configuration of a driving circuit 200 disclosed in JP-A No. 2001-108966.

Since the differential amplifier 10A illustrated in FIG. 1 has high input impedance, the output of the resistance-division-type digital-to-analog converter (R-DAC 30A) having high output impedance can be received as it is. In this regard, the driving circuit 200 disclosed in JP-A No. 2001-108966 has to supply deficient charge of a reference potential line inside a liquid crystal panel 201 through resistors $R_C$ and $R_B$ and a voltage feedback line L2 by a driving signal of an original input (wave A1). That is, the original input needs to have sufficient current supply capability, and cannot directly receive the output of the high-output impedance digital-to-analog converter such as the R-DAC 30A. Therefore, an amplification circuit that performs impedance conversion becomes necessary between the driving circuit 200 and the digital-to-analog converter. Accordingly, in a case in which a multi-output circuit such as the data line driver of the display device is configured, a circuit scale increases, an area of a semiconductor chip is increases, and a cost becomes high.

In addition, in the driving circuit 200 disclosed in JP-A No. 2001-108966, the output voltage $V_{OUT}$ of the operational amplifier OP1, which is derived by imaginarily short-circuiting the non-inverting input terminal and the inverting input terminal of the operational amplifier OP1, can be expressed by Expression (1) below.

$$V_{OUT}=V_D+(V_D-V_{A1})\times(R_B+Z)/R_C \quad (1)$$

Here, $V_D$ is a reference voltage set by $R_D$ and a voltage V, $V_{A1}$ is a voltage corresponding to a driving signal (wave A1), and Z is a combined impedance of a liquid crystal panel 201, a capacitor C, and a resistor $R_A$. From Expression (1), the output voltage $V_{OUT}$ is a driving signal in which a center voltage of an input waveform is set to $V_D$, and an amplification factor is set to a value greater than or equal to $R_B/R_C$ (usually greater than 1).

The output voltage $V_{OUT}$ is a gradation voltage corresponding to a video data signal. Even in a case in which output voltage $V_{OUT}$ outputs the same gradation voltage in one data period, a voltage difference which changes according to a voltage in a previous data period is different. According to the driving circuit 200 illustrated in FIG. 3, in a case in which the gradation voltage (target voltage) corresponding to the voltage $V_{A1}$ is output as $V_{OUT}$ in one data period, the voltage change amount of the output voltage $V_{OUT}$ is more than or equal to $(V_D-V_{A1})\times(R_B/R_C)$, regardless of the magnitude of the output voltage in the previous data period. That is, the voltage change of the output voltage $V_{OUT}$ of the driving circuit 200 involves a voltage change action of a magnitude which is independent of a voltage difference between the target voltage in one data period and the output voltage $V_{OUT}$ in the previous data period. Therefore, in a case in which voltage difference between the target voltage and the output voltage $V_{OUT}$ in the previous data period is small, excessive overshoot or undershoot occurs in the voltage waveform of the output voltage $V_{OUT}$ in the data period.

SUMMARY

The present disclosure provides an output circuit that may prevent occurrence of excessive overshoot and undershoot in an output voltage.

A first aspect of the present disclosure is an output circuit including: a differential amplifier that includes an inverting input terminal, plural non-inverting input terminals and an output terminal, the differential amplifier outputting, as an output voltage from the output terminal, a voltage having a level corresponding to a weighted average of levels of respective input voltages input to the plural non-inverting input terminals, in a case in which a level of the output voltage output from the output terminal is equal to a level of a voltage input to the inverting input terminal, and the differential amplifier outputting, as the output voltage, a voltage having a level corresponding to a difference between a level corresponding to a weighted average of the levels of the respective input voltages input to the plural non-inverting input terminals and the level of the voltage input to the inverting input terminal, in a case in which the level of the output voltage is different from the level of the voltage input to the inverting input terminal; and a delay circuit that generates a delay voltage responding with a predetermined time constant with respect to a change in the voltage level of the output terminal and supplies the delay voltage to the inverting input terminal.

A second aspect of the present disclosure is a data line driver including: the output circuit according to the first aspect; and a digital-to-analog converter that supplies a signal voltage to each of the plural non-inverting input terminals.

A third aspect of the present disclosure is a display device including: the output circuit according to the first aspect; a digital-to-analog converter that supplies a signal voltage to each of the plural non-inverting input terminals; and a display panel having a data line to which the output voltage of the output circuit is supplied as a gradation voltage.

According to the above aspects, the present disclosure provides the output circuit that may prevent occurrence of excessive overshoot and undershoot in the output voltage.

BRIEF DESCRIPTION OF THE DRAWINGS

Exemplary embodiments will be described in detail based on the following figures, wherein.

DETAILED DESCRIPTION

Figure 1:
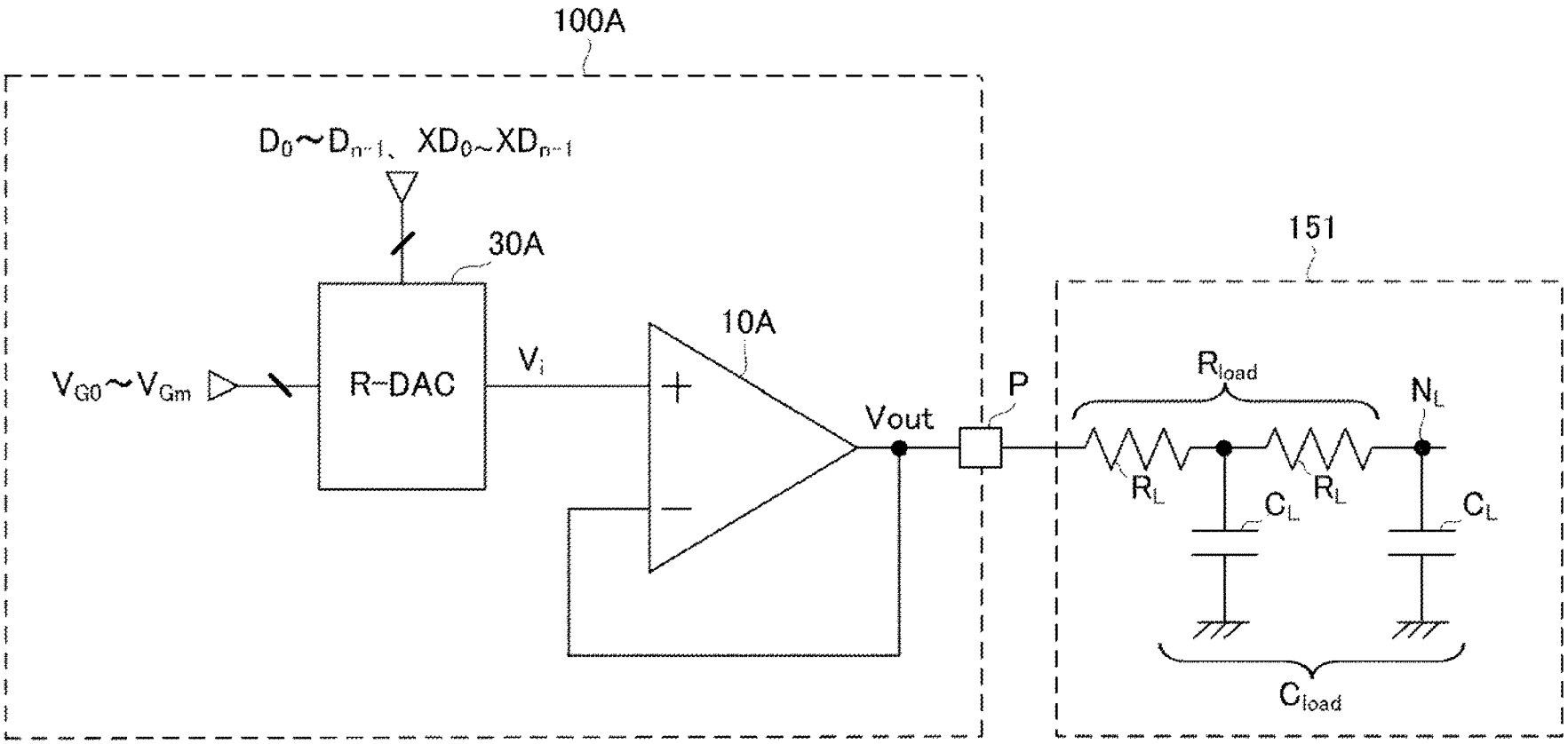
FIG. 1 is a circuit block diagram illustrating an example configuration of a data line driver.

Hereinafter, exemplary embodiments of the present disclosure will be described with reference to the drawings. In the drawings, the substantially same or equivalent elements or portions are denoted by the same reference numerals.

First Exemplary Embodiment

Figure 4:
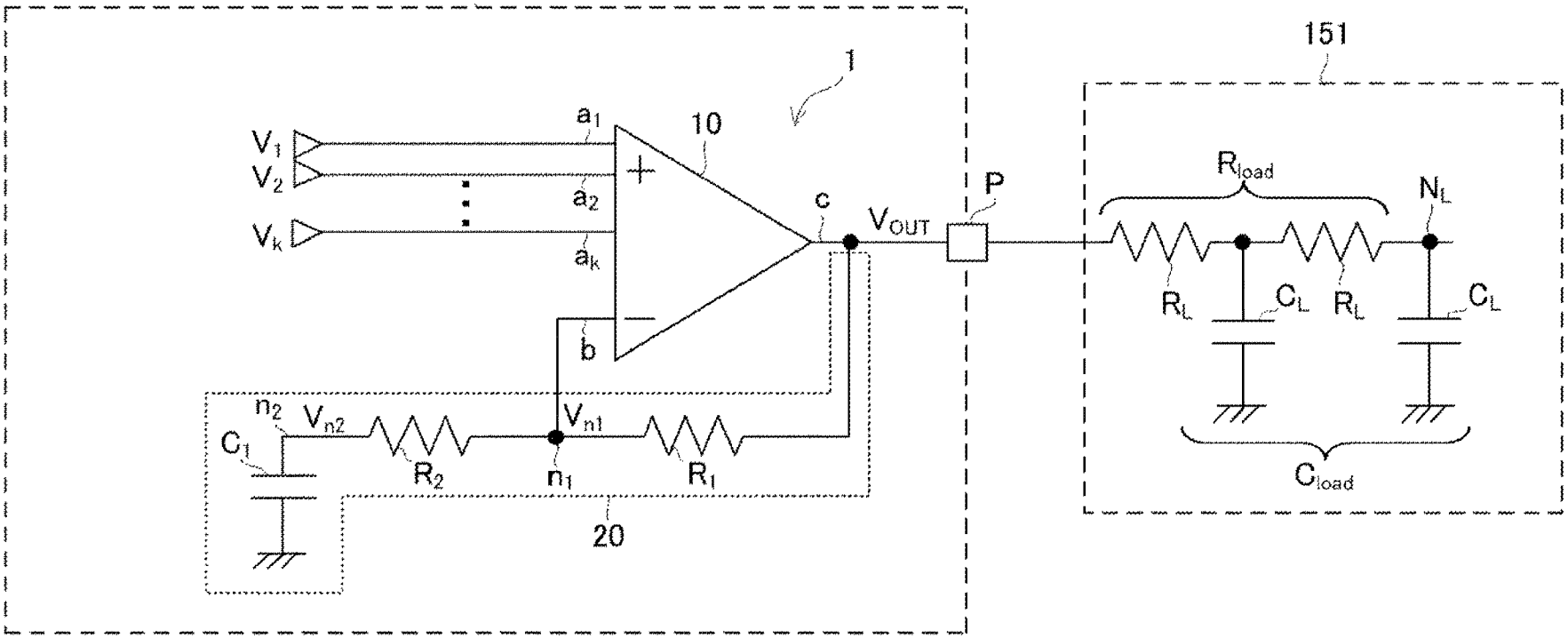
FIG. 4 is a circuit block diagram illustrating a configuration of an output circuit according to an exemplary embodiment of the present disclosure.

FIG. 4 is a circuit block diagram illustrating a configuration of an output circuit 1 according to a first exemplary embodiment of the present disclosure. In FIG. 4, a data line 151 connected to the output circuit 1 is illustrated together with the output circuit 1.

The output circuit 1 is configured to include a differential amplifier 10 and a delay circuit 20, and is formed in a semiconductor chip 50. The differential amplifier 10 has an inverting input terminal b, plural non-inverting input terminals $a_1, a_2, \ldots, a_k$, and an output terminal c. The output terminal c is connected to the data line 151 through an output pad P of the semiconductor chip 50. A configuration corresponding to one data line 151 is illustrated in FIG. 4, but the semiconductor chip 50 may include plural output circuits corresponding to plural data lines provided in a display device such as a liquid crystal panel.

Signal voltages $V_1, V_2, \ldots, V_k$ are input to the plural non-inverting input terminals $a_1$ to $a_k$, respectively. The signal voltages $V_1$ to $V_k$ are output from a resistance-division-type digital-to-analog converter (not illustrated) provided in the preceding stage of the output circuit 1. The signal voltages $V_1$ to $V_k$ are step signal voltages, of which the voltage levels vary stepwise, and are k voltage groups including the same voltage within a voltage range which is sufficiently smaller than an output dynamic range of the differential amplifier 10. The differential amplifier 10 outputs the output voltage $V_{OUT}$ corresponding to the magnitude of the k signal voltages $V_1$ to $V_k$, which are input to the non-inverting input terminals $a_1$ to $a_k$, from the output terminal c as the gradation voltage, so as to drive the data line 151 connected to the output terminal c. Since the configuration of the data line 151 is the same as that illustrated in FIG. 1, a description thereof is omitted.

The delay circuit 20 is configured to include resistive elements $R_1$ and $R_2$ and a capacitor $C_1$, which are connected in series between the output terminal c of the differential amplifier 10 and a constant potential line (ground line). That is, one end of the resistive element $R_1$ is connected to the output terminal c of the differential amplifier 10, one end of the resistive element $R_2$ is connected to the other end of the resistive element $R_1$, one end of the capacitor $C_1$ is connected to the other end of the resistive element $R_2$, and the other end of the capacitor $C_1$ is connected to the constant potential line (ground line). In addition, a node $n_1$, which is a connection portion between the resistive element $R_1$ and the resistive element $R_2$, is connected to the inverting input terminal b of the differential amplifier 10. That is, the delay circuit 20 outputs a delay voltage ($V_{n1}$), which responds with a time constant $r_2$ ($=C_1 \cdot (R_1+R_2)$) determined by the resistance values of the resistive elements $R_1$ and $R_2$ and the capacitance value of the capacitor $C_1$, at the node $n_1$ according to a change in the voltage level of the output voltage $V_{OUT}$ of the differential amplifier 10, and supplies the delay voltage $V_{n1}$ to the inverting input terminal b of the differential amplifier 10. In this exemplary embodiment, a case in which the delay circuit 20 includes a series resistor circuit including two resistive elements $R_1$ and $R_2$ connected in series is illustrated. However, the delay circuit 20 may be configured to include a series resistor circuit including three or more resistive elements connected in series. In this case, any connection portion between the resistive elements in the plural resistive elements is connected to the inverting input terminal b of the differential amplifier 10. In this exemplary embodiment, a ground line is used as the constant potential line. However, a voltage line having a fixed potential other than the ground line may be used as the constant potential line.

The resistance values of the resistive elements $R_1$ and $R_2$ and the capacitance value of the capacitor $C_1$ are set such that a delay time until the voltage change of the output voltage $V_{OUT}$ is reflected to a voltage $V_{n2}$ generated at a node $n_2$ is shorter than a delay time until the voltage change of the output voltage $V_{OUT}$ is reflected to a voltage of a far end node $N_L$ of the data line 151. Note that, the node n2 is a connection point between the capacitor C1 and the resistive element R2. Specifically, the resistance values of the resistive elements $R_1$ and $R_2$ and the capacitance value of the capacitor $C_1$ are set such that the time constant $\tau_2$ ($=C_1 \cdot (R_1+R_2)$) is smaller than the time constant $\tau_1$ ($=R_{load} \cdot C_{load}$). Note that the time constant $\tau_2$ ($=C_1 \cdot (R_1+R_2)$) is a measure of a delay from the output terminal c of the differential amplifier 10 to the node $n_2$. Further, the time constant $\tau_1$ ($=R_{load} \cdot C_{load}$) is a measure of a delay from the output terminal c to the far end node $N_L$. In addition, in order to suppress power loss in the delay circuit 20, the resistance values of the resistive elements $R_1$ and $R_2$ are preferably set to sufficiently large values, and the capacitance value of the capacitor $C_1$ is preferably set to a sufficiently small value.

In a case in which the level of the output voltage $V_{OUT}$ output from the output terminal c is equal to the level of the voltage input to the inverting input terminal b, the differential amplifier 10 operates as a voltage follower having an amplification factor of 1. That is, in a case in which the output voltage $V_{OUT}$ output from the output terminal c is stable and the voltage level of the output voltage $V_{OUT}$ and the voltage levels of the voltages $V_{n1}$ and $V_{n2}$ generated at the nodes $n_1$ and $n_2$ of the delay circuit 20 are equal to one another ($V_{OUT}=V_{n1}=V_{n2}$), the differential amplifier 10 operates as a voltage follower having an amplification factor of 1.

The differential amplifier 10 outputs, as the gradation voltage, the output voltage $V_{OUT}$ of the voltage level corresponding to a weighted average of the levels of the signal voltages $V_1$ to $V_k$ input to the non-inverting input terminals $a_1$ to $a_k$ in a case in which the amplification factor is 1. That is, in a case in which it is assumed that if the output voltage $V_{OUT}$ when the amplification factor of the differential amplifier 10 is 1 is $V_{exp}$, $V_{exp}$ is expressed by Expression (2) below.

$$V_{exp}=(A_1 \cdot V_1+A_2 \cdot V_2+ \ldots +A_k \cdot V_k)/(A_1+A_2+ \ldots +A_k) \quad (2)$$

$A_1, A_2, \ldots A_k$ are weighting coefficients corresponding to the signal voltages $V_1$ to $V_k$, respectively. $V_{exp}$ is the voltage level of the output voltage $V_{OUT}$ in the stable state and is the voltage level of the target gradation voltage. The configuration of the differential amplifier 10 which realizes Expression (2) will be described later.

In a case in which the level of the output voltage $V_{OUT}$ output from the output terminal c is different from the level of the voltage $V_{n1}$ input to the inverting input terminal b, the differential amplifier 10 outputs, as the output voltage $V_{OUT}$, the voltage corresponding to the difference between the level ($V_{exp}$) corresponding to the weighted average of the levels of the signal voltages $V_1$ to $V_k$ input to the non-inverting input terminals $a_1$ to $a_k$ and the level of the voltage input to the inverting input terminal b. Therefore, in a period from the start of the change according to the level change in the signal voltages $V_1$ to $V_k$ to the stable state, the output voltage $V_{OUT}$ of the differential amplifier 10 changes with the change amount corresponding to the potential difference between the output terminal c and the node $n_2$. In the following, this point will be described.

In a case in which the output voltage $V_{OUT}$ of the differential amplifier 10 changes, a current $I_f$ expressed by Expression (3) below flows to the delay circuit 20 due to the potential difference generated between the output terminal c of the differential amplifier 10 and the node $n_2$ of the delay circuit 20.

$$I_f=(V_{OUT}-V_{n1})/R_1=(V_{n1}-V_{n2})/R_2 \quad (3)$$

$V_{n1}$ is a voltage generated at the node $n_1$, and $V_{n2}$ is a voltage generated at the node $n_2$. In a case in which an imaginary short is established between the inverting input terminal b and the non-inverting input terminals $a_1$ to $a_k$ of the differential amplifier 10, the level of the voltage $V_{n1}$ of the node $n_1$ input to the inverting input terminal b is $V_{exp}$. Therefore, Expression (4) below is derived by replacing $V_{n1}$ in Expression (3) with $V_{exp}$ and solving it for $V_{OUT}$.

$$V_{OUT}=(R_1/R_2) \cdot (V_{exp}-V_{n2})+V_{exp} \quad (4)$$

That is, in the period from the start of the change according to the change in the voltage levels of the signal voltages $V_1$ to $V_k$ to the stable state, the output voltage $V_{OUT}$ of the differential amplifier 10 is changed by the voltage change amount determined by the product of the difference between $V_{exp}$ corresponding to the weighted average of the signal voltages $V_1$ to $V_k$, the voltage $V_{n2}$ generated at the node $n_2$ of the delay circuit 20, and the resistance ratio $R_1/R_2$.

The changing action of the output voltage $V_{OUT}$ expressed by Expression (4) will be described in more detail. The signal voltages $V_1$ to $V_k$ are step signal voltages, of which the voltage levels change stepwise, respectively. Therefore, $V_{exp}$ corresponding to a weighted average thereof also changes stepwise. Even in a case in which the voltage level of the output voltage $V_{OUT}$ reaches the target voltage $V_{exp}$, if the voltage level of the voltage $V_{n2}$ of the node $n_2$ of the delay circuit 20 does not reach the target voltage $V_{exp}$, the voltage level of the output voltage $V_{OUT}$ continues to change. In a case in which the voltage level of the voltage $V_{n2}$ of the node $n_2$ reaches the target voltage $V_{exp}$, the action of the voltage change amount of the output voltage $V_{OUT}$ becomes zero, and the voltage level of the output voltage $V_{OUT}$ converges to $V_{exp}$.

Figure 2:
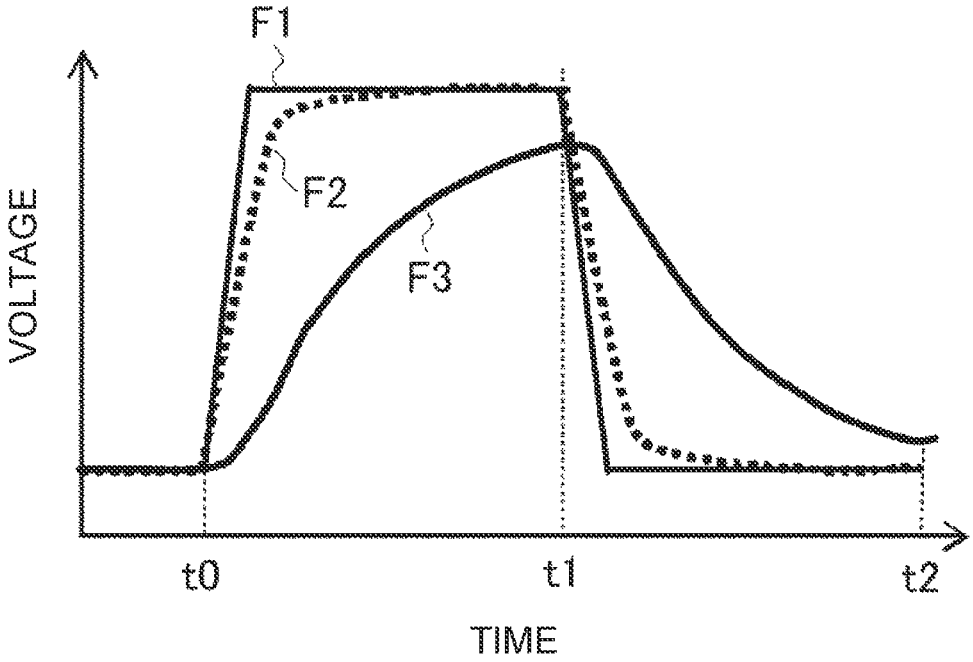
FIG. 2 is a view illustrating an example of a voltage waveform of each of a data line driver and a data line.
Figure 5:
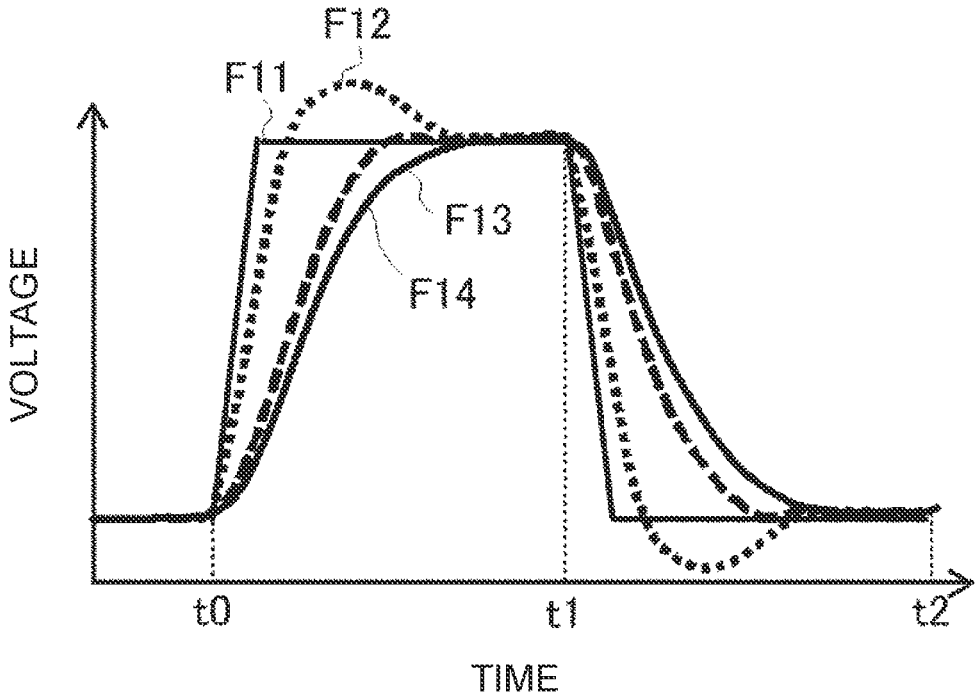
FIG. 5 is a diagram illustrating a voltage waveform at each node of a differential amplifier and a data line according to an exemplary embodiment of the present disclosure.

FIG. 5 is a view illustrating a voltage waveform at each node of the differential amplifier 10 and the data line 151 when the signal voltages $V_1$ to $V_k$ are input to the differential amplifier 10. FIG. 5 illustrates the voltage waveform of each node in a case in which the load capacity of the data line 151 is relatively large and the driving period (one data period) is relatively short, as in the case illustrated in FIG. 2.

A waveform F11 is a virtual input voltage waveform corresponding to the weighted average of the signal voltages $V_1$ to $V_k$ input to the differential amplifier 10. A waveform F12 is a waveform of the output voltage $V_{OUT}$ output from the output terminal c of the differential amplifier 10, that is, a voltage waveform of the near end node of the data line 151. A waveform F13 is a voltage waveform of the far end node $N_L$ of the data line 151. A waveform F14 is a waveform of the voltage $V_{n2}$ generated at the node $n_2$ of the delay circuit 20. The time constant $\tau_2$ ($=C_1 \cdot (R_1+R_2)$) in the delay circuit 20 is determined such that the delay of the waveform F14 with respect to the waveform F11 is smaller than the delay of the waveform F13 with respect to the waveform F11.

As indicated by the waveform F12, the output voltage $V_{OUT}$ (the voltage of the near end node of the data line 151) quickly reaches the voltage level of the target voltage $V_{exp}$ at a constant slew rate determined by the circuit configuration of the differential amplifier 10. Further, even thereafter, the output voltage $V_{OUT}$ continues to change due to the action of the voltage change amount $(R_1/R_2) \cdot (V_{exp}-V_{n2})$ corresponding to the difference between the target voltage $V_{exp}$ and the voltage $V_{n2}$ of the node $n_2$ of the delay circuit 20, as expressed in Expression (4). Therefore, the waveform F12 of the output voltage $V_{OUT}$ is an overshoot waveform. As the level of the voltage $V_{n2}$ of the node $n_2$ approaches the target voltage $V_{exp}$, the action of the voltage change amount $(R_1/R_2) \cdot (V_{exp}-V_{n2})$ at the output voltage $V_{OUT}$ becomes small, and the output voltage $V_{OUT}$ finally converges to the target voltage $V_{exp}$. In addition, as indicated by the waveforms F13 and F14, the voltage of the far end node $N_L$ of the data line 151 and the voltage $V_{n2}$ of the node $n_2$ of the delay circuit 20 quickly converge to the target voltage $V_{exp}$.

As the output voltage $V_{OUT}$ overshoots, the voltage change at the far end node $N_L$ of the data line 151 is accelerated, and the time until the voltage level of the far end node $N_L$ reaches the target voltage $V_{exp}$ is shortened. Therefore, even in a case in which the load capacity of the data line 151 is large and the driving period (one data period) is short, the voltage of the far end node $N_L$ of the data line 151 can reach the target voltage $V_{exp}$ within the driving period (one data period). Therefore, the voltage difference between the near end node and the far end node $N_L$ of the data line 151 can be suppressed, and the luminance difference between the near end node and the far end node $N_L$ may be suppressed.

In addition, in a case in which the amplitude of the waveform F11 is sufficiently small, the action of the voltage change amount of the output voltage $V_{OUT}$ in the period until the stable state is small as indicated by Expression (4). Therefore, excessive overshoot does not occur at the output voltage $V_{OUT}$, and the output voltage $V_{OUT}$ quickly converges to the target voltage $V_{exp}$.

The case in which the data line 151 is charged to the output voltage $V_{OUT}$ has been described above as an example, but the same applies to a case in which the data line 151 is discharged to the output voltage $V_{OUT}$. Excessive undershoot does not occur in the voltage waveform of the output voltage $V_{OUT}$, and the output voltage $V_{OUT}$ quickly converges to the target voltage $V_{exp}$.

Figure 3:
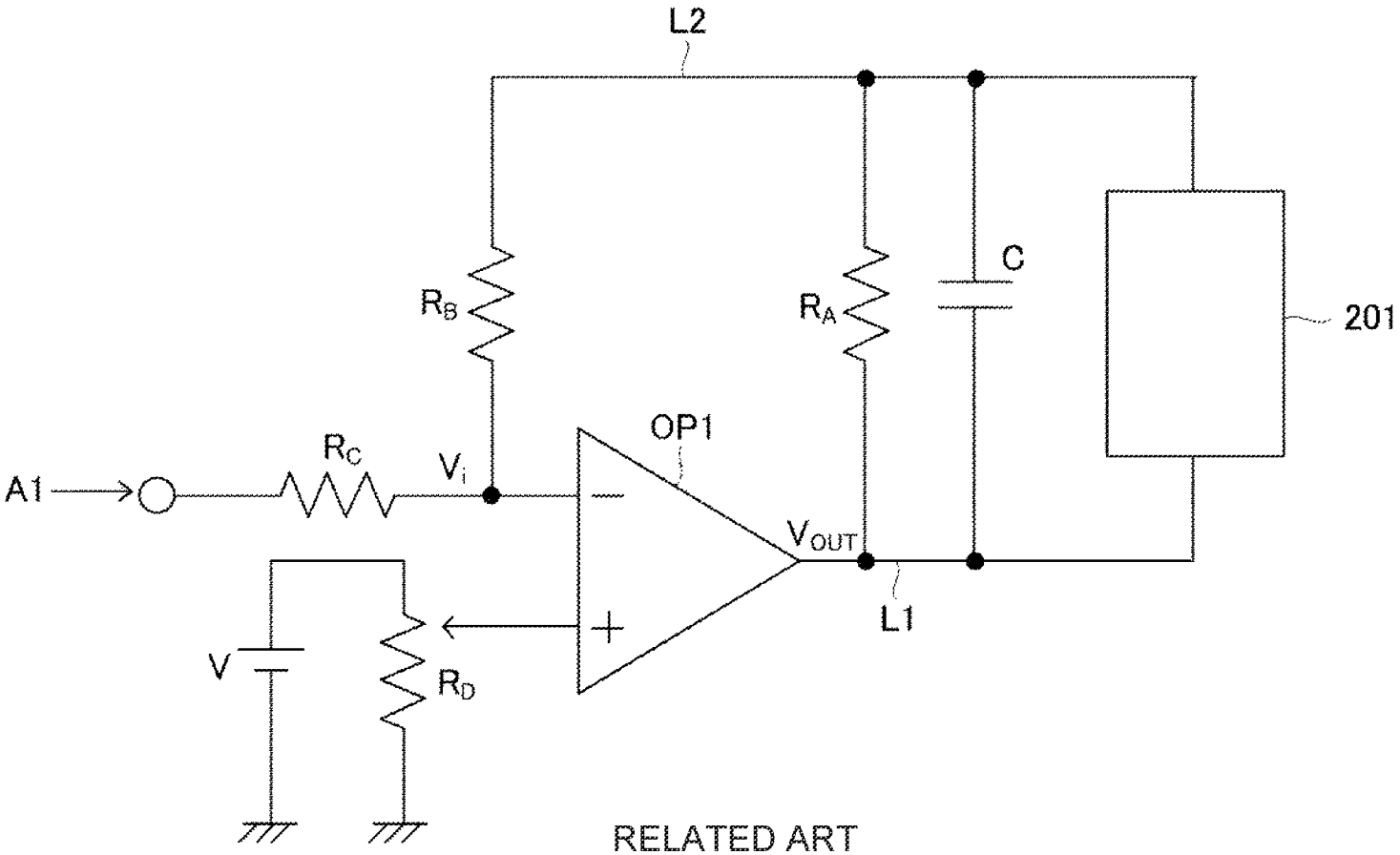
FIG. 3 is a circuit block diagram illustrating a configuration of a driving circuit.

Here, the driving circuit 200 illustrated in FIG. 3 is compared with the output circuit 1 according to the exemplary embodiment of the present disclosure. The driving circuit 200 illustrated in FIG. 3 requires a high current supply capability for an input signal and cannot directly receive the output signal of the resistance-division-type digital-to-analog converter having high output impedance.

The output circuit 1 according to the exemplary embodiment of the present disclosure does not require a high current supply capability for an input signal because the input impedance thereof is high. Therefore, the output signal of the resistance-division-type digital-to-analog converter having high output impedance can be received as it is. Therefore, the output circuit 1 can be realized with a simple configuration, and in the case of configuring a multiple output circuit such as the data line driver of the display device, a circuit scale may be reduced. Therefore, the present exemplary embodiment may suppress the area of the semiconductor chip and to achieve the cost reduction.

In addition, the voltage change of the output voltage $V_{OUT}$ of the driving circuit 200 illustrated in FIG. 3 involves a voltage change action of a magnitude which is independent of a voltage difference between the target voltage and the output voltage $V_{OUT}$ in the previous data period. Therefore, in a case in which the voltage difference between the target voltage in the data period and the output voltage $V_{OUT}$ in the previous data period is small, overshoot or undershoot may occur in the voltage waveform of the output voltage $V_{OUT}$ in the data period.

According to the output circuit 1 according to the exemplary embodiment of the present disclosure, the voltage change of the output voltage $V_{OUT}$ in the data period involves a voltage change action of the voltage change amount $(R_1/R_2)\cdot(V_{exp}-V_{n2})$ corresponding to the voltage difference between the target voltage $V_{exp}$ in the data period and the output voltage $V_{OUT}$ in the previous data period ($V_{n2}$ at the start of the data period). That is, in a case in which the voltage difference $(V_{exp}-V_{n2})$ between the target voltage $V_{exp}$ in the data period and the output voltage $V_{OUT}$ $(=V_{n2})$ in the previous data period is large, the output voltage $V_{OUT}$ involves a large voltage change action. In a case in which the voltage difference $(V_{exp}-V_{n2})$ is small, the output voltage $V_{OUT}$ involves a small voltage change action. Therefore, in a case in which the voltage difference between the target voltage $V_{exp}$ in the data period and the output voltage $V_{OUT}$ $(=V_{n2})$ in the previous data period is small, it is possible to prevent excessive overshoot and undershoot from occurring in the voltage waveform of the output voltage $V_{OUT}$ in the data period.

Figure 6:
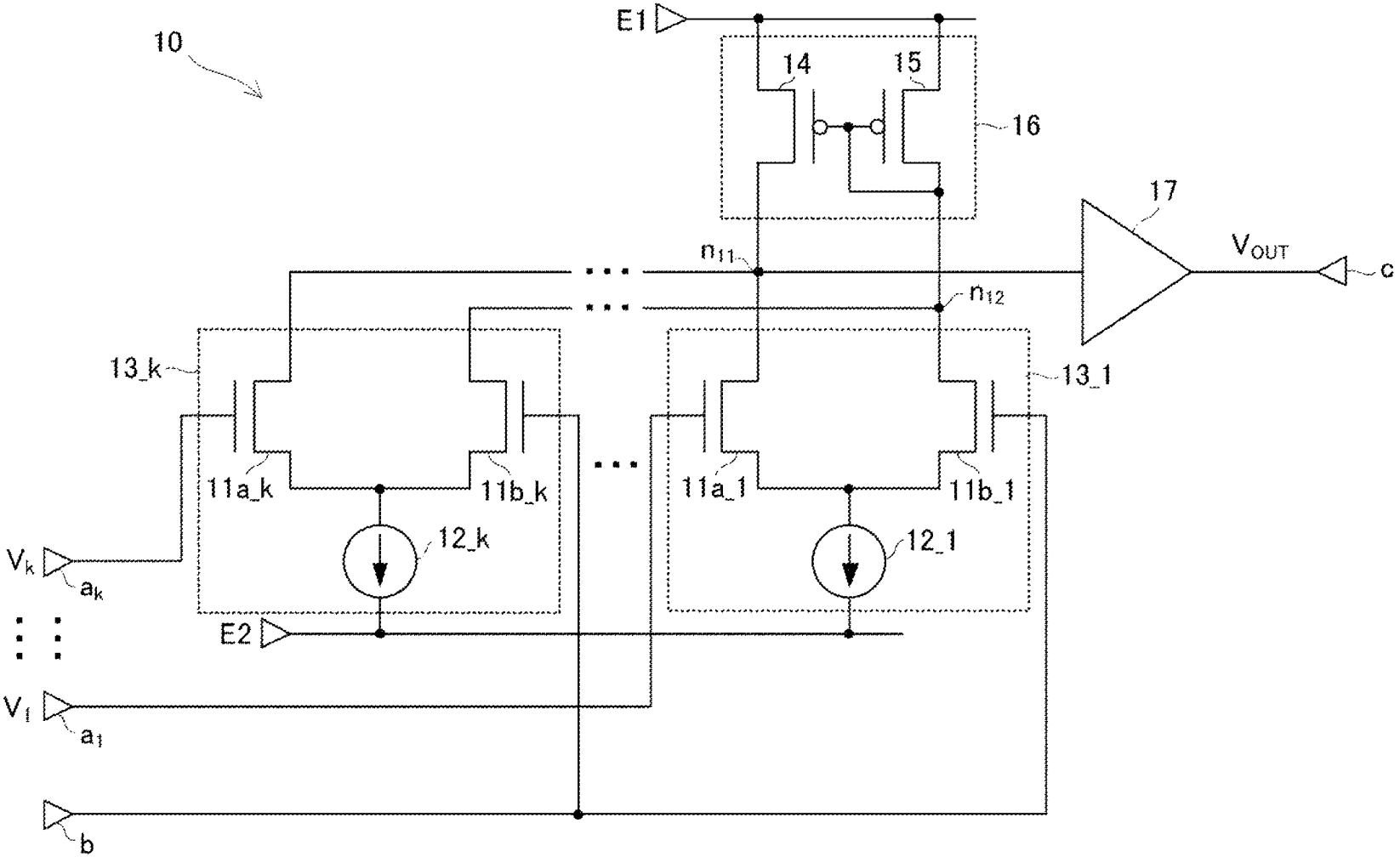
FIG. 6 is a circuit diagram illustrating an example configuration of a differential amplifier according to an exemplary embodiment of the present disclosure.

FIG. 6 is a circuit diagram illustrating an example configuration of the differential amplifier 10. The differential amplifier 10 includes k differential stage circuits 13_1 to **13_*k* having the same conductivity type, a current mirror circuit 16, and an amplification stage circuit 17**.

The differential stage circuit **13_*k* has a differential pair including N-channel transistors 11*a*_*k* and 11*b*_*k* and a current source 12_*k* which drives the differential pair. The current source 12_*k* is provided between a tail of the differential pair and a power supply terminal E2. The configuration of the other differential stage circuit is the same as that of the differential stage circuit 13_*k*. Gates of the transistors 11*a*_1 to 11*a*_*k* of one side of each differential pair configure the non-inverting input terminals $a_1$ to $a_k$ of the differential amplifier 10. Gates of the other transistors 11*b*_1 to 11*b*_*k* of the other side of each differential pair are commonly connected to configure the inverting input terminal b of the differential amplifier 10. In the differential stage circuits 13_1 to 13_*k***, the output ends of the differential pairs are commonly connected at the nodes $n_{11}$ and $n_{12}$, respectively.

The current mirror circuit 16 has p-channel transistors 14 and 15, and is provided between a power supply terminal E1 and the nodes $n_{11}$ and $n_{12}$. The amplification stage circuit 17 receives the voltage generated at at least the node $n_{11}$, and amplifies and outputs the output voltage $V_{OUT}$ to the output terminal c of the differential amplifier 10. In a case in which the potentials of the inverting input terminal b and the output terminal c of the differential amplifier 10 are equal to each other, the differential amplifier 10 is equivalent to a voltage follower configuration having an amplification factor of 1. The voltage level of the output voltage $V_{OUT}$ at this time is set as a voltage $V_{exp}$.

Hereinafter, the relationship between the signal voltages $V_1$ to $V_k$ and the voltage $V_{exp}$ in a case in which the amplification factor of the differential amplifier 10 is 1 will be described. As described above, the signal voltages $V_1$ to $V_k$ are step signal voltages, of which the voltage levels vary stepwise, and are k voltage groups including the same voltage within a voltage range which is sufficiently smaller than an output dynamic range of the differential amplifier 10. The voltage $V_{exp}$ corresponds to the weighted average of the input signal voltages $V_1$ to $V_k$ in a case in which the amplification factor of the differential amplifier 10 is 1.

Hereinafter, in the differential amplifier 10, an operation of a case in which transistors constituting a j-th differential pair (j is an integer of from 1 to k) in the differential stage circuits 13_1 to **13_*k*** are $A_j$ times the reference size ratio (W/L) (namely, the weighting ratio is $A_j$) will be described as an example. Note that the reference size ratio (W/L) corresponds to a ratio of the channel length L and the channel width W.

Drain currents $L_{a_j}$ and $I_{b_j}$ of the j-th differential pair (**11*a*_*j*, 11*b*_*j***) are expressed by Expressions (5) and (6) below.

$$I_{a_j}=(A_j\cdot\beta/2)\cdot(V_j-V_{TH})^2 \quad (5)$$

$$I_{b_j}=(A_j\cdot\beta/2)\cdot(V_{exp}-V_{TH})^2 \quad (6)$$

β is a gain coefficient in a case in which the transistor has a reference size ratio of 1, and $V_{TH}$ is a threshold voltage of the transistor.

The commonly connected output ends of the differential stage circuits 13_1 to 13_k are connected to the input (node $n_{12}$) and the output (node $n_{11}$) of the current mirror circuit 16, and the output currents of the commonly connected output terminals of the differential stage circuits 13_1 to 13_k are controlled to be equal to one another. Therefore, Expression (7) below is established with respect to the output currents of the differential stage circuits 13_1 to 13_k.

$$I_{a_1}+I_{a_2}+\ldots+I_{a_k}=I_{b_1}+I_{b_2}+\ldots+I_{b_k} \quad (7)$$

In Expressions (5) and (6), j is developed in the range of from 1 to k and substituted into Expression (7). Regarding the primary term of the threshold voltage $V_{TH}$, when both sides are equal, Expressions (8) and (9) are derived.

$$A_1 \cdot V_1+A_2 \cdot V_2+\ldots+A_k \cdot V_k=(A_1+A_2+\ldots+A_k)\times V_{exp} \quad (8)$$

$$V_{exp}=(A_1 \cdot V_1+\ldots+A_k \cdot V_k)/(A_1+\ldots+A_k) \quad (9)$$

Alternatively, in a case in which the mutual conductance of the differential pair of the reference size is gm and the mutual conductance of the j-th differential pair of the weighting ratio $A_j$ is $A_j \cdot gm$, the j-th (j=1 to k) differential pair (11*a_j*, 11*b_j*) is as follows:

$$Ia\text{-}j\text{-}Ib\text{-}j=A_j \cdot gm(V_j-V_{exp}) \quad (10)$$

Here, even in a case in which j is substituted into Expression (7) developed in the range of from 1 to k, Expression (9) above is derived.

Accordingly, as expressed in Expression (9), the differential amplifier 10 outputs, as the output voltage $V_{OUT}$, the value obtained by dividing the sum $(A_1 \cdot V_1+\ldots+A_k \cdot V_k)$ of the product of the signal voltage input to each differential pair and the weighting ratio by the sum $(A_1+\ldots+A_k)$ of the weighting ratios, that is, the voltage $V_{exp}$ corresponding to the weighted average of the signal voltages $V_1$ to $V_k$.

For example, in a case in which two voltages consisting of two voltages $V_A$ and $V_B$ having different voltage levels are input as the signal voltages $V_1$ to $V_k$, the voltage level dividing the voltages $V_A$ and $V_B$ into $2^K$ pieces can be generated in the differential amplifier 10. This makes it possible to reduce the number of voltage levels selectively output by the digital-to-analog converter provided in the preceding stage of the differential amplifier 10. In particular, in a case in which the number of bits of the video digital signal is large, the circuit scale of the digital-to-analog converter is large and the chip area is increased. However, this may suppress an increase in chip area by reducing the number of voltage levels selectively output by the digital-to-analog converter.

Second Exemplary Embodiment

Figure 7:
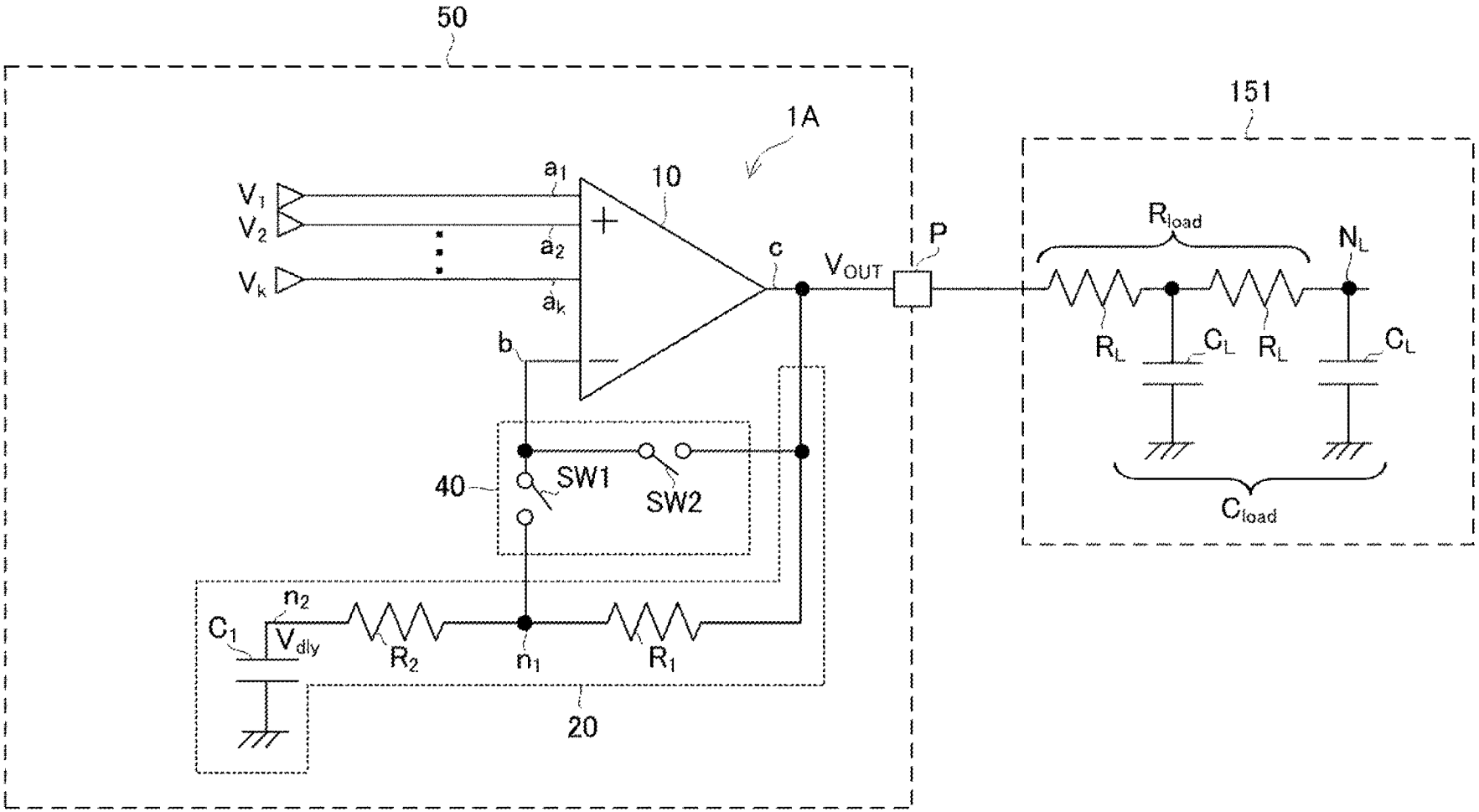
FIG. 7 is a circuit block diagram illustrating a configuration of an output circuit according to another exemplary embodiment of the present disclosure.

FIG. 7 is a circuit block diagram illustrating a configuration of an output circuit 1A according to a second exemplary embodiment of the present disclosure. The output circuit 1A differs from the output circuit 1 according to the first exemplary embodiment in that the output circuit 1A includes a switching circuit 40 which switches a connection destination of an inverting input terminal b of a differential amplifier 10 to one of a node $n_1$, which is an output node of a delay voltage ($V_{n1}$) in a delay circuit 20, and an output terminal c. The switching circuit 40 is configured to include switches SW1 and SW2.

The switch SW1 is provided between the inverting input terminal b of the differential amplifier 10 and the node $n_1$ of the delay circuit 20. The switch SW2 is provided between the inverting input terminal b of the differential amplifier 10 and the output terminal c. In a case in which the switch SW2 is turned ON and the switch SW1 is turned OFF, the differential amplifier 10 constitutes a voltage follower having an amplification factor of 1. In a case in which the switch SW2 is turned OFF and the switch SW1 is turned ON, the differential amplifier 10 operates with a voltage change action in which the output voltage $V_{OUT}$ corresponds to the difference between the voltage $V_{exp}$ and the voltage $V_{n2}$ of the node $n_2$, as expressed in Expression (4).

Figure 8:
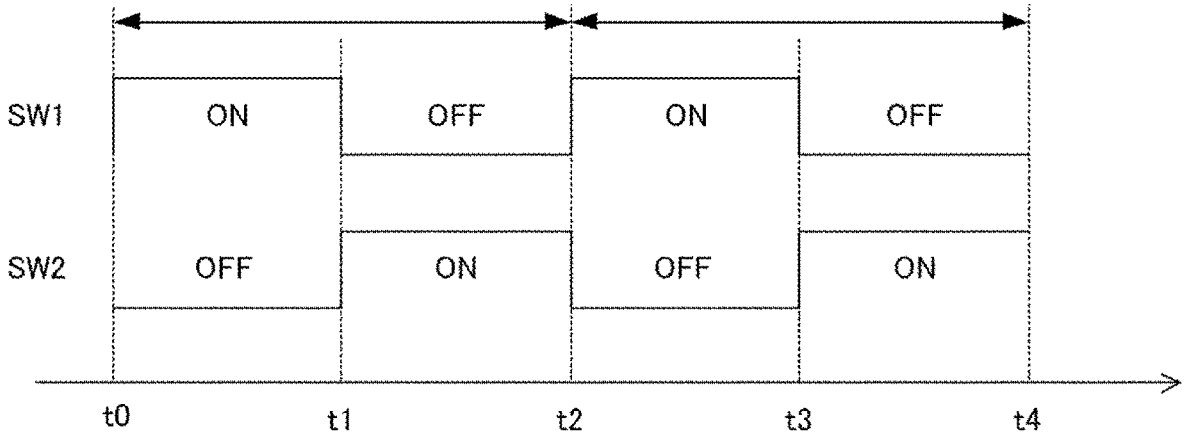
FIG. 8 is a timing chart illustrating an example of ON/OFF timings of two switches according to an exemplary embodiment of the present disclosure.

FIG. 8 is a timing chart illustrating an example of a timing of turning ON and OFF the switches SW1 and SW2. In the example illustrated in FIG. 8, an example of ON/OFF timings of the switches SW1 and SW2 in a first data period 1H-1 from time t0 to time t2 and a second data period 1H-2 from time t2 to time t4 is shown. In one data period, with respect to the output voltage $V_{OUT}$ output from the output terminal c of the differential amplifier 10, the voltage level of the target voltage $V_{exp}$ is maintained at the same level.

In the first half period (the period from time t0 to time t1) of the first data period 1H-1 and the first half period (the period from time t2 to time t3) of the second data period 1H-2, the switch SW1 is in an ON state and the switch SW2 is in an OFF state. Therefore, in the above-described period, the differential amplifier 10 operates with a voltage change in which the output voltage $V_{OUT}$ corresponds to the difference between the voltage $V_{exp}$ and the voltage $V_{n2}$ of the node $n_2$, as expressed in Expression (4). In the second half period (the period from time t1 to time t2) of the first data period 1H-1 and the second half period (the period from time t3 to time t4) of the second data period 1H-2, the switch SW1 is in an OFF state and the switch SW2 is in an ON state. Therefore, the differential amplifier 10 constitutes a voltage follower having an amplification factor of 1.

According to the output circuit 1A of the second exemplary embodiment, as in the output circuit 1 according to the first exemplary embodiment, occurrence of excessive overshoot and undershoot at the output voltage $V_{OUT}$ may be prevented, and switching of the differential amplifier 10 to the voltage follower driving at an appropriate timing becomes possible.

Third Exemplary Embodiment

Figure 9:
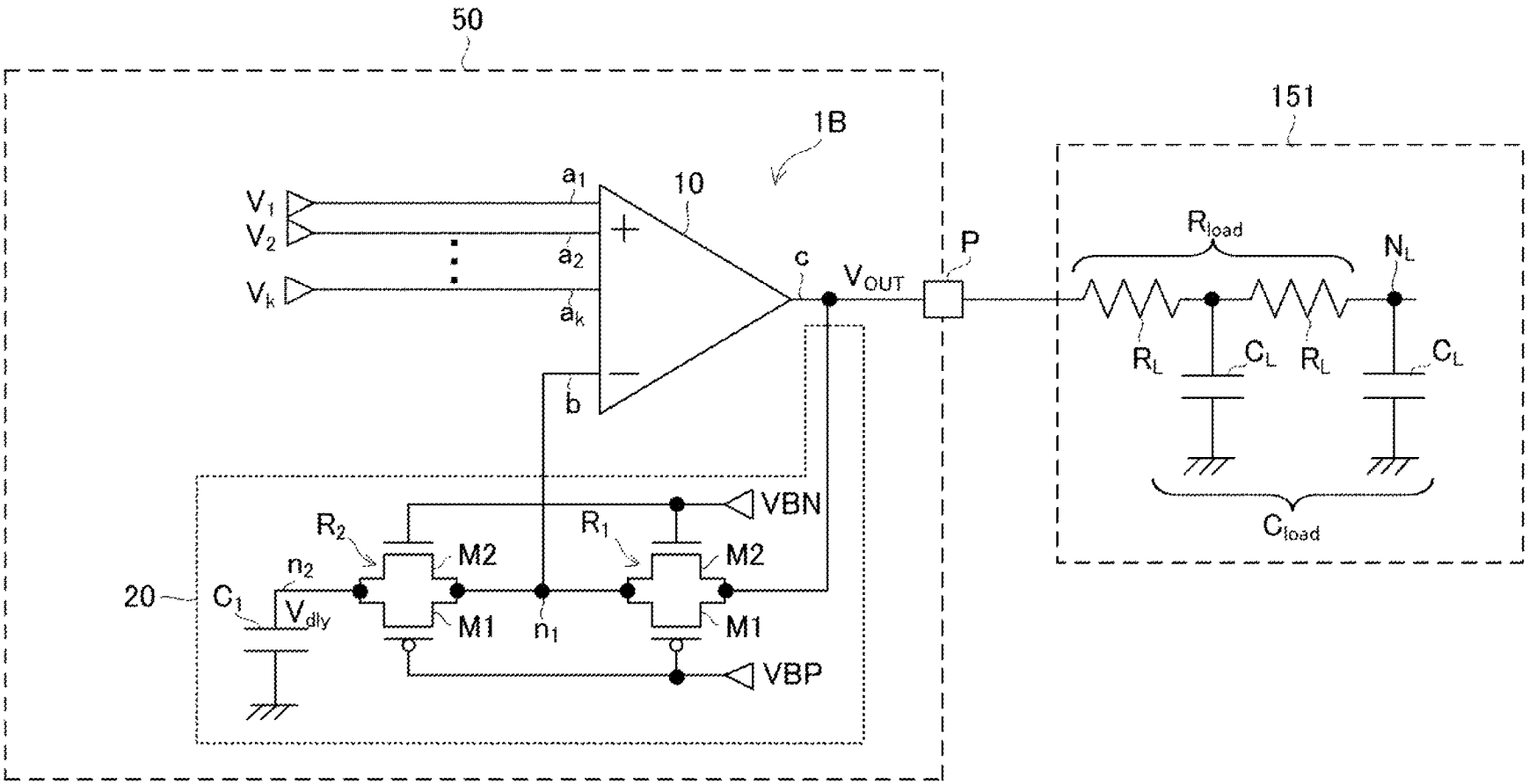
FIG. 9 is a circuit block diagram illustrating a configuration of an output circuit according to another exemplary embodiment of the present disclosure.

FIG. 9 is a circuit block diagram illustrating a configuration of an output circuit 1B according to a third exemplary embodiment of the present disclosure. The output circuit 1B differs from the output circuit 1 according to the first exemplary embodiment in that resistive elements $R_1$ and $R_2$ constituting a delay circuit 20 are each constituted by a CMOS transistor resistor.

Each of the resistive elements $R_1$ and $R_2$ is configured to include a p-channel MOS transistor M1 and an n-channel MOS transistor M2. A drain and a source of the p-channel MOS transistor M1 are connected to a source and a drain of the n-channel MOS transistor M2. A gate of the p-channel MOS transistor M1 is connected to a voltage line VBP, and a gate of the n-channel MOS transistor M2 is connected to a voltage line VBN. By applying a bias voltage to the gates, which are control terminals of the MOS transistors M1 and M2, through the voltage lines VBP and VBN, the resistive elements $R_1$ and $R_2$ have resistance values corresponding to the sizes and bias voltages of the MOS transistors M1 and M2 constituting the respective resistive elements.

Since the resistive values of the resistive elements $R_1$ and $R_2$ are required to be sufficiently large, there is a possibility that the area will be large if the resistive elements are configured with general resistor dedicated elements or the like. By configuring the resistive elements $R_1$ and $R_2$ with CMOS transistor resistors, the present exemplary embodiment may reduce the area of the resistive elements $R_1$ and $R_2$, as compared with the case in which the resistive elements are configured with general resistor dedicated elements.

CMOS transistor resistors may also be applied to the resistive elements $R_1$ and $R_2$ constituting the delay circuit 20 in the output circuit 1A illustrated in FIG. 7.

Fourth Exemplary Embodiment

Figure 10:
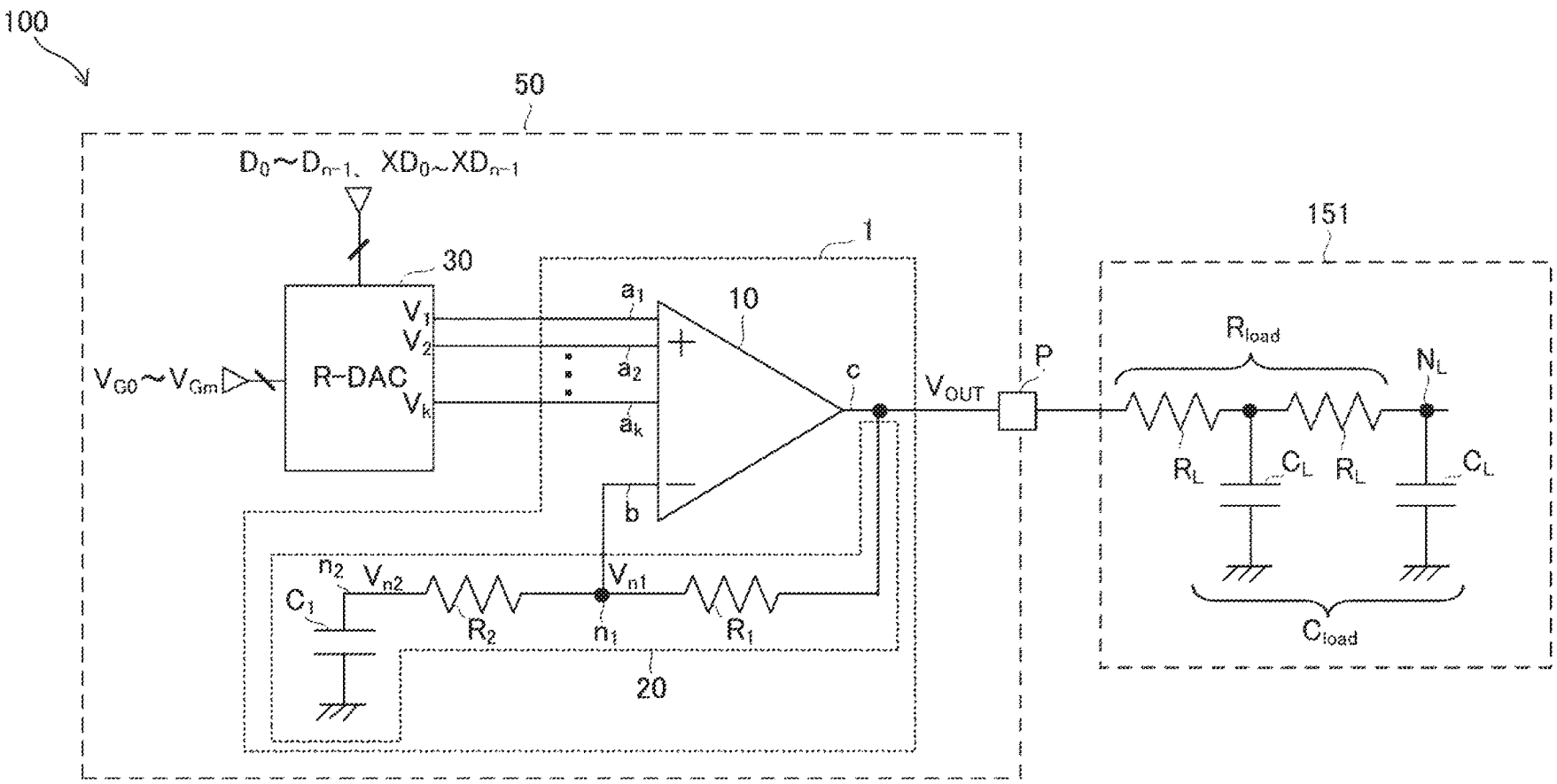
FIG. 10 is a circuit block diagram illustrating a configuration of a data line driver according to an exemplary embodiment of the present disclosure.

FIG. 10 is a circuit block diagram illustrating a configuration of a data line driver 100 according to a fourth exemplary embodiment of the present disclosure. The data line driver 100 is configured to include an output circuit 1 including at least a differential amplifier 10 and a delay circuit 20, and a resistance-division-type digital-to-analog converter 30 (hereinafter referred to as an R-DAC 30). The data line driver 100 is formed in a semiconductor chip 50, and an output terminal c of the output circuit 1 is connected to a data line 151 through an output pad P of the semiconductor chip 50. As in the R-DAC 30A illustrated in FIG. 1, plural gamma power supply voltages $V_{G0}$ to $V_{Gm}$, n-bit video digital signals $D_0$ to $D_{n-1}$, and complementary signals $XD_0$ to $XD_{n-1}$ thereof are input to the R-DAC 30. Even in the R-DAC 30, plural reference voltages are generated by resistance division of the gamma power supply voltages $V_{G0}$ to $V_{Gm}$. The R-DAC 30 is a configuration change of the R-DAC 30A illustrated in FIG. 1, such that k signal voltages $V_1$ to $V_k$ including superimposition from plural reference voltages are selectively output with respect to the video digital signals ($D_0$ to $D_{n-1}$ and $XD_0$ to $XD_{n-1}$). The signal voltages $V_1$ to $V_k$ output from the R-DAC 30 are input to the non-inverting input terminals $a_1$ to $a_k$ of the differential amplifier 10, respectively. As described in the first exemplary embodiment, the number of reference voltage levels generated in the digital-to-analog converter R-DAC 30 connected to the preceding stage of the differential amplifier 10 can be reduced as compared with the R-DAC 30A. Therefore, the circuit scale and area of the R-DAC 30 can be reduced. A configuration corresponding to one data line 151 is illustrated in FIG. 10, but the semiconductor chip 50 may include plural output circuits 1 and R-DACs 30 corresponding to plural data lines provided in a display device such as a liquid crystal panel.

Since the output circuit 1 has high input impedance, the output circuit 1 can receive the output of the R-DAC 30, which is a resistance-division-type digital-to-analog converter having high output impedance (low current driving capability), as it is. Therefore, as in the data line driver 100A illustrated in FIG. 1, the data line driver 100 can be realized with a simple configuration, and in the case of configuring a multiple output circuit such as the data line driver of the display device, a circuit scale can be reduced. Therefore, the present exemplary embodiment may suppress the area of the semiconductor chip and to achieve the cost reduction.

In the data line driver 100, instead of the output circuit 1, the output circuit 1A illustrated in FIG. 7 or the output circuit 1B illustrated in FIG. 9 may be applied.

Fifth Exemplary Embodiment

Figure 11:
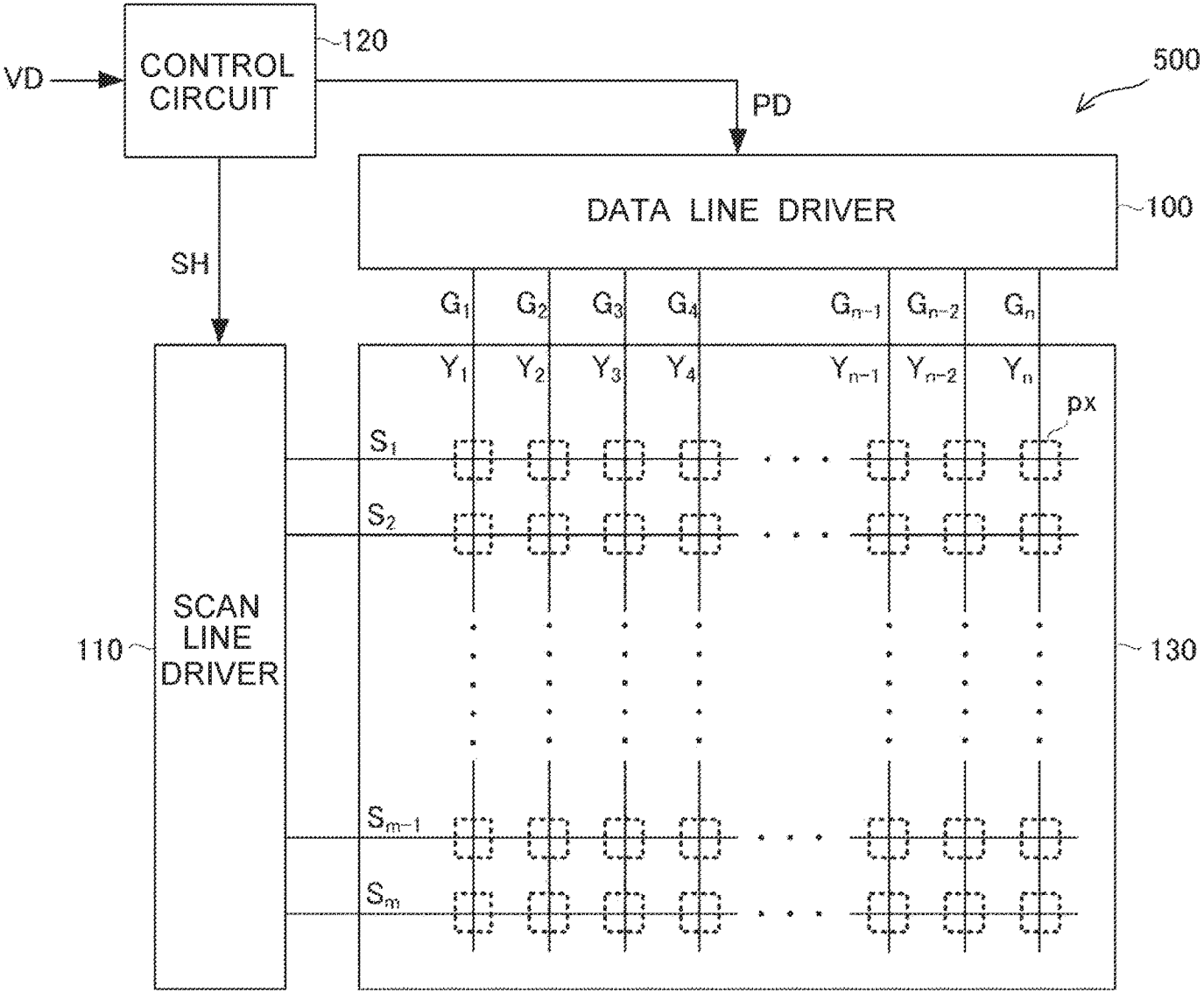
FIG. 11 is a diagram illustrating a configuration of a display device according to an exemplary embodiment of the present disclosure.

FIG. 11 is a view illustrating a configuration of an active matrix display device 500 according to a fifth exemplary embodiment of the present disclosure. The display device is configured to include a data line driver 100 according to the fourth exemplary embodiment, a scan line driver 110, a control circuit 120, and a display panel 130.

The display panel 130 constitutes, for example, a liquid crystal panel or an organic EL panel, and has m scan lines $S_1$ to $S_m$ (m is a natural number of 2 or more) extending in a first direction of a display screen, and n data lines $Y_1$ to $Y_n$ (n is a natural number of 2 or more) extending in a second direction orthogonal to the first direction. A TFT switch (not illustrated) and a display cell px serving as a pixel are provided at each intersection of the scan lines $S_1$ to $S_m$ and the data lines $Y_1$ to $Y_n$. In a case in which the TFT switch is turned ON by a scan pulse of the scan line, a gradation voltage of each data line is applied to a pixel electrode in the display cell, and the luminance control of RGB is performed according to the applied gradation voltage.

The control circuit 120 detects a horizontal synchronization signal SH from a video signal VD input from the outside and supplies the detected horizontal synchronization signal SH to the scan line driver 110. In addition, the control circuit 120 generates various control signals and a series of pixel data PD representing luminance levels of each pixel by luminance gradation of, for example, 8 bits, based on the video signal VD, and supplies the same to the data line driver 100.

The scan line driver 110 sequentially applies horizontal scan pulses to the respective scan lines $S_1$ to $S_m$ of the display panel 130 at a timing synchronized with the horizontal synchronization signal SH supplied from the control circuit 120.

The data line driver 100 is formed in, for example, a semiconductor chip constituting a large scale integrated circuit (LSI). The data line driver 100 converts the pixel data PD supplied from the control circuit 120 into gradation voltage signals $G_1$ to $G_n$ having gradation levels corresponding to each pixel data PD for each scan line, that is for every n. The data line driver 100 applies the gradation voltage signals $G_1$ to $G_n$ to the data lines $Y_1$ to $Y_n$ of the display panel 130.

The display device 500 according to the present exemplary embodiment may suppress the luminance difference between the near end node and the far end node of the display panel 130. In addition, the present exemplary embodiment may prevent excessive overshoot and undershoot in the gradation voltage signals $G_1$ to $G_n$. Therefore, it is possible to realize high image quality of the image displayed on the display panel 130.

In the display device 500, any one of the output circuits 1,1A,1B according to the first to third exemplary embodiments may be applied as the output circuit constituting the data line driver 100.

What is claimed is:

1. An output circuit comprising:

a differential amplifier that includes an inverting input terminal, a plurality of non-inverting input terminals and an output terminal, the differential amplifier outputting, as an output voltage from the output terminal, a voltage having a level corresponding to a weighted average of levels of respective input voltages input to the plurality of non-inverting input terminals, in a case in which a level of the output voltage output from the output terminal is equal to a level of a voltage input to the inverting input terminal, and the differential amplifier outputting, as the output voltage, a voltage having a level corresponding to a difference between the level corresponding to the weighted average of the levels of the respective input voltages input to the plurality of non-inverting input terminals and the level of the voltage input to the inverting input terminal, in a case in which the level of the output voltage is different from the level of the voltage input to the inverting input terminal; and a delay circuit that generates a delay voltage responding with a predetermined time constant with respect to a change in the voltage level of the output terminal and supplies the delay voltage to the inverting input terminal, wherein the delay circuit includes a series resistor circuit having one end connected to the output terminal and including a plurality of resistive elements connected in series, and a capacitor having one end connected to an other end of the series resistor circuit and an other end connected to a constant voltage line, and the inverting input terminal is connected to one of connection portions between the resistive elements in the plurality of resistive elements, and wherein each of the plurality of resistive elements includes a transistor having a control terminal to which a bias voltage is applied.

2. The output circuit according to claim 1, further comprising a switching circuit that switches a connection destination of the inverting input terminal to one of an output node of the delay voltage in the delay circuit or the output terminal.

3. The output circuit according to claim 2, wherein:

the switching circuit includes a first switch provided between the inverting input terminal and the output node of the delay voltage in the delay circuit, and a second switch provided between the inverting input terminal and the output terminal; and the first switch is in an ON state and the second switch is in an OFF state in a first half period within one unit period in which the level of the output voltage maintains a same level, and the first switch is in an OFF state and the second switch is in an ON state in a second half period within the one unit period.

4. The output circuit according to claim 1, wherein:

the differential amplifier includes a differential stage circuit including a plurality of differential pairs of a same conductivity type, a current mirror circuit commonly connected to output ends of the plurality of differential pairs, and an amplification stage circuit;

one input end of each of the plurality of differential pairs configures the plurality of non-inverting input terminals, and an other input end of each of the plurality of differential pairs is commonly connected to configure the inverting input terminal; and the amplification stage circuit receives a voltage of at least one of connection portions between the output ends of the plurality of differential pairs and the current mirror circuit, and outputs the output voltage to the output terminal.

5. A data line driver comprising:

the output circuit according to claim 1; and a digital-to-analog converter that supplies a signal voltage to each of the plurality of non-inverting input terminals.

6. A display device comprising:

the output circuit according to claim 1;

a digital-to-analog converter that supplies a signal voltage to each of the plurality of non-inverting input terminals; and a display panel having a data line to which the output voltage of the output circuit is supplied as a gradation voltage.

* * * * *